United States Patent [19]

Beachboard

[11] Patent Number: 4,819,716

[45] Date of Patent: Apr. 11, 1989

[54] ADVANCED ZONE DAMPER SYSTEM

[76] Inventor: Stephen A. Beachboard, P.O. Box 616448, Orlando, Fla. 32861-6448

[21] Appl. No.: 39,444

[22] Filed: Apr. 17, 1987

Related U.S. Application Data

[63] Continuation-in-part of Ser. No. 638,244, Aug. 6, 1984, Pat. No. 4,673,029.

[51] Int. Cl.[4] ..... F24F 3/00; F24F 7/00

[52] U.S. Cl. ..... 165/21; 165/22; 165/30; 165/25; 236/49.1; 236/44 C; 236/1 B

[58] Field of Search ..... 62/428; 165/21, 22, 165/30, 25; 236/1 B, 1 C, 49, 44 C

[56] References Cited

U.S. PATENT DOCUMENTS

| | | | |
|---|---|---|---|
| 2,158,628 | 5/1939 | Kuhlman | 236/1 B |
| 2,287,268 | 6/1942 | Palmer | 165/21 |
| 2,468,830 | 5/1949 | Markham | 236/1 B |
| 2,747,383 | 5/1956 | Schlumbohm | 62/428 |
| 2,930,208 | 3/1960 | Lyman | 62/428 |
| 3,127,103 | 3/1964 | Grogan | 236/1 B |
| 3,297,250 | 1/1967 | Capps | 236/1 C |
| 3,786,859 | 1/1974 | Day | 165/21 |
| 3,989,097 | 11/1976 | Schildkrecht | 165/21 |
| 4,185,769 | 1/1980 | Nezwozski | 236/1 C |
| 4,277,019 | 7/1981 | Shreve | 165/22 |
| 4,673,029 | 6/1987 | Beachboard | 236/49 D |

FOREIGN PATENT DOCUMENTS

| | | | |
|---|---|---|---|
| 1187966 | 5/1985 | Canada | 165/22 |

OTHER PUBLICATIONS

Air Pressure Dumper Damper, publication of Zone-A-Trol.

*Primary Examiner*—Albert W. Davis, Jr.
*Assistant Examiner*—John K. Ford

[57] ABSTRACT

The advanced zone damper incorporates an adjustable, spring loaded damper door control which allows any percentage up to 50% of the total air flow to pass through a locked damper door when only two dampers are used in a multizone heating and cooling system. The stated percentage is relative to when two dampers are used, and may vary greatly with system design and the number of dampers and zones in the system. A humidistat and manual control over system functions is also a great improvement over the thermostat control only. Often in a two or more zone system, where the air conditioner is large enough for the building, there may be humidity control problems in any zone which the present invention's controls compensate for by damper doors being unlocked simultaneously while the air conditioner and the heater may both be operating simultaneously so that humidity is removed by the air conditioner while cooling, and heat is added by the heater. This process removes humidity but may not change the air temperature. Also the mechanical damper door control may be adjusted to help reduce over cooling and loss of humidity control.

1 Claim, 1 Drawing Sheet

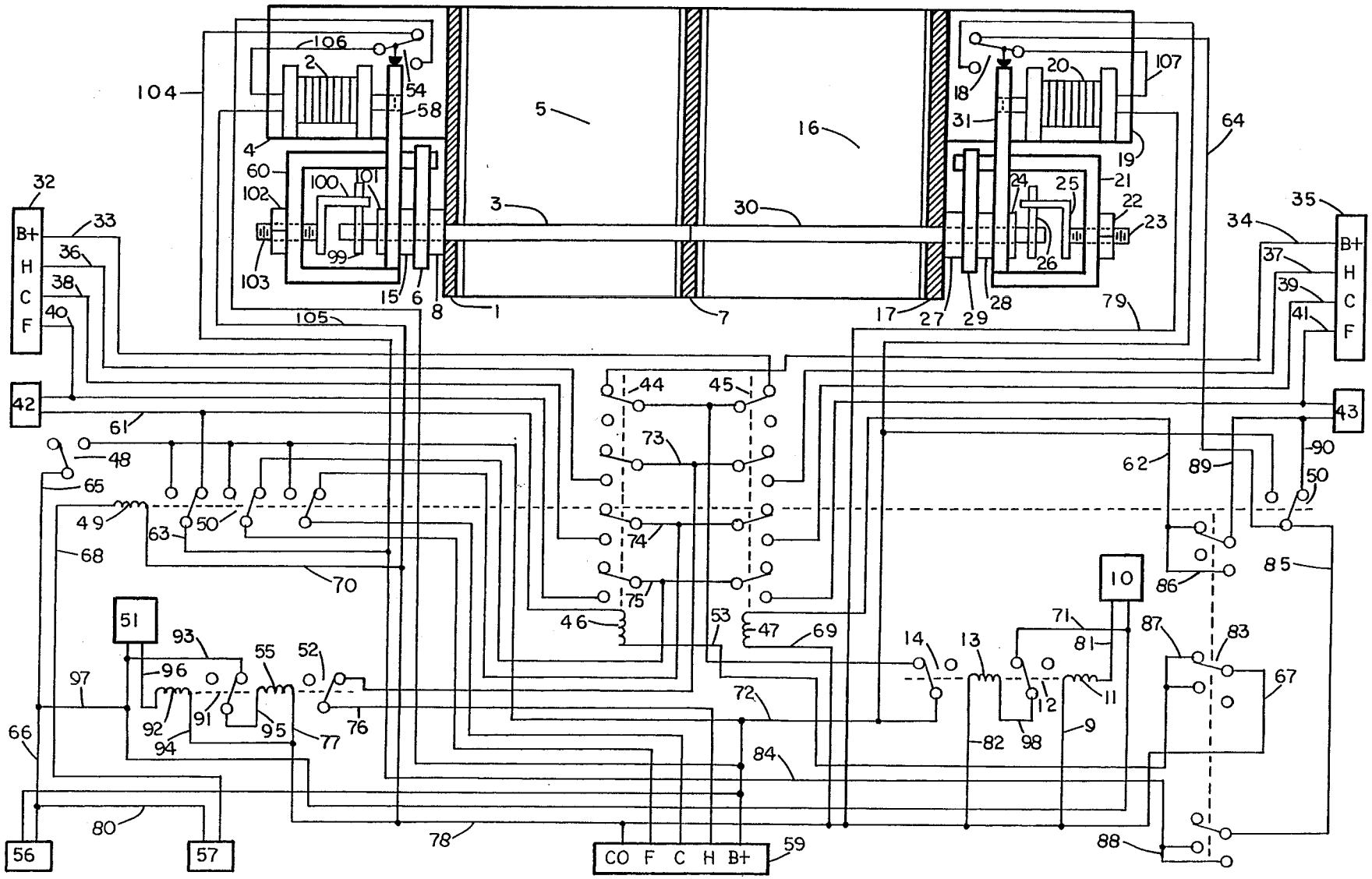
B+
H
C
F
CO
F
C
H
B+

ADVANCED ZONE DAMPER SYSTEM

CROSS-REFERENCE TO RELATED APPLICATION

This application is a continuation-in-part of application Ser. No. 06/638,244, filed Aug. 6, 1984, now U.S. Pat. No. 4,673,029 issued June 16, 1987.

The Advanced Zone Damper System relates directly to heating and cooling as well as humidity control systems, but it is also applicable to refrigeration, ventilation and air distribution systems in general.

BACKGROUND OF THE INVENTION

1. Field of the Invention

The present invention is classified as an Air Conditioning System. This is an accurate description of the Advanced Zone Damper System but just as every patentable invention is unique, it is difficult to catagorize the present invention into one and only one classification.

2. Description of the Prior Art

The present invention; Advanced Zone Damper System is a modification or advanced design of the air conditioning control system in the Patent entitled Zoned Heat and Air Conditioning System, U.S. Pat. No. 4,673,029 incorporated by reference for the sake of disclosure. The Zoned Heat and Air Conditioning System allows a damper to be opened or closed as illustrated in FIGS. 2, 3, 4, 5, 6, and 7 of that Patent. FIG. 8 of that Patent allows air to be evenly divided between two zones. When Zones are equal in size or air flow requirements are equal, the Zoned Heat and Air Conditioning System works well, but when zones are of unequal sizes or require unequal amounts of heating or cooling, the Advanced Zone Damper System adapts to any circumstances that may be encountered. When the Zoned Heat and Air Conditioning System damper is locked, then the damper may not be opened by air flow, but when the Advanced Zone Damper System is locked, an adjustable amount of air may flow through the damper. This modification of the locking damper allows unequal zones to be conditioned dumping or diverting excessive air flow from smaller zones to areas where the air can be more effectively used or returned to the heater or air conditioner's return air. The present invention utilizes a damper of superior design with far greater versatility. The control circuitry of the present invention is much more complex than the circuitry of the Zoned Heat and Air Conditioning System's control system. The present invention incorporates a control switch which allows either thermostat to also control both dampers with both dampers unlocked just as a normal air conditioning system. There can be humidity control problems in the Zoned Heat and Air Conditioning System when the air conditioner is sized for control of all zones. When a humidistat and a manual control switch are incorporated in the control circuitry, all zone dampers can be opened and the air conditioner can be energized to reduce humidity. A plurality of humidistats can be installed in a parallel circuit for accurately monitoring humidity in all zones. In situations where the zone temperature is too cold, either thermostat's heat control can be turned on so both heat and air conditioning are operating simultaneously. The heater will only operate to bring the room temperature up to the temperature desired according to the setting of the thermostat.

There is presently available on the market today a device called a Dumper Damper. This device is similar to the damper in the Advanced Zone Damper System but there are great improvements in the present invention. The Dumper Damper has an adjustable counter weight which controls the amount of air which may pass where the Advanced Zone Damper System has an adjustable spring which performs this function and there is a door lock which separates this spring tension door control from a virtual free opening door when the door is unlocked. The Dumper Damper is slightly similar but by no means represents the Advanced Zone Damper System's damper.

SUMMARY OF THE INVENTION

The Advanced Zone Damper System heats, cools and controls humidity in buildings accurately in different zones or areas as required by the building's operator(s). The Zoned Heat and Air Conditioning System has problems when different size zones are controlled in the system while the present invention adapts easily to different size zones or heat loads. The Zoned Heat and Air Conditioning System has no controls for humidity control nor controls giving options for single thermostat control while the Advanced Zone Damper System allows all these capabilities and options for better temperature control. The Advanced Zone Damper System enables a building to be heated, cooled or dehumidified at a lower cost because of better control, and because the size of the heater and/or air conditioner need not be as large, the cost of installation need not be as great as in conventional installations. The present invention also allows large groups of people to assemble in one zone comfortably in hot weather where a conventional one zone system would be inadequate. The Advanced Zone Damper System is a far more sophisticated damper than the Dumper Damper since the Dumper Damper has no controls and has only one adjustment. The Dumper Damper may perform only one of the many possible functions of the Advanced Zone Damper System but could never take its place.

BRIEF DESCRIPTION OF THE DRAWING

The sole FIGURE shows a dual-damper assembly according to this invention.

DESCRIPTION OF THE INVENTION

The drawing shows a dual hamper assembly with the damper control circuitry and heat and air conditioning control circuitry. The damper door 5 is affixed to axle 3 and controls air flow in the left duct section. The damper door 16 is affixed to axle 30 and controls air flow in the right duct section. The left and right dampers are separated by damper wall 7 and damper wall 1 encloses the left damper door and damper wall 17 encloses the right damper door. Damper doors 5 and 16 are shown in sections of duct which can be inserted and connected in a duct system individually in different locations. The axles 3 and 30 are not restricted to the position in the damper doors 5 and 16 respectively as shown, but may be moved to any point on the damper doors 5 and 16. The right damper door 16 is shown attached to axle 30 which is affixed to secondary control arm 29. Secondary control arm 29 is separated from the damper wall 17 by spacer 27. The primary control arm 31 is separated from the secondary control arm 29 by spacer 28. Retainer clip 24 holds the primary control arm 31 in place on axle 30. Secondary control arm 29 is affixed to axle 30. Spring 26 is also affixed to axle 30 and spring tension is applied by spring adjustment arm 25 which is adjusted by rotating spring adjustment screw 23 which is locked in place by lock nut 22. Primary control arm 31 is welded to spring adjustment bracket 21 which also serves as the secondary control arm 29's stop to limit its travel. Spring tension applied to axle 30 by spring 26 forces secondary control arm 29 against spring adjustment bracket 21. Since both damper door 16 and secondary control arm 29 are both affixed to axle 30, when air pressure is applied to damper door 16 and solenoid 20 is in its at rest position as shown, locking primary control arm 31 securely in its at rest position, the air pressure may force damper door 16 open a controlled amount determined by spring 26 which is adjusted by spring adjustment screw 23. When no air pressure is applied to damper door 16, then spring 26 forces the damper door 16 to close and also forces secondary control arm 29 to its at rest position against spring adjustment bracket 21. When solenoid 20 which is mounted to solenoid bracket 19 which is mounted to damper wall 17 is energized, it releases primary control arm 31 and air pressure may easily open damper door 16 and gravity may close damper door 16. When primary control arm 31 leaves its at rest position then pressure switch 18 disconnects power to solenoid 20 through circuit 64 which originated from thermostat 35 and applies power to solenoid 20 from the source B+ through circuit 72 from air conditioner 59. Circuit 107 connects solenoid 20 to switch 18 where the B+ power source is determined. B+ power is applied to solenoid 20 through circuit 72 by switch 18 until primary control arm 31 has returned to its at rest position at which time switch 18 disconnects B+ power from solenoid 20. Electric power originates at B+ at air conditioner 59 including both heating and cooling capability and is disconnected from solenoid 20 by switch 18 allowing solenoid 20 to go back to its at rest position and lock primary control arm 31 in place. The left damper door 5 is shown attached to axle 3 which is affixed to secondary control arm 6. Secondary control arm 6 is separated from the damper wall 1 by spacer 8. The primary control arm 58 is separated from the secondary control arm 6 by spacer 15. Retainer clip 101 holds the primary control arm 58 in place on axle 3. Secondary control arm 6 is affixed to axle 3. Spring 99 is also affixed to axle 3 and spring tension is applied by spring adjustment arm 100 which is adjusted by rotating spring adjustment screw 103 which is locked in place by lock nut 102. Primary control arm 58 is welded to spring adjustment bracket 60 which also serves as the secondary control arm 6's stop to limit its travel. Spring tension applied to axle 3 by spring 99 forces secondary control arm 6 against spring adjustment bracket 60. Since both damper door 5 and secondary control arm 6 are both affixed to axle 3, when air pressure is applied to damper door 5 and solenoid 2 is in its at rest position as shown locking primary control arm 58 securely in its at rest position, the air pressure may force damper door 5 open a controlled amount determined by spring 99 which is adjusted by spring adjustment screw 103. When no air pressure is applied to damper door 5, then spring 99 forces the damper door 5 to close and also forces secondary control arm 6 to its at rest position against spring adjustment bracket 60. When solenoid 2, which is mounted to solenoid bracket 4 which is mounted to damper wall 1 is energized, it releases primary control arm 58 and air pressure may easily open damper door 5, and gravity may close damper door 5. When primary control arm 58 leaves its at rest position then pressure switch 54 disconnects power to solenoid 2 through circuit 104 which originated from thermostat 32 and applies B+ power to solenoid 2 from the source B+ through circuit 72 from air conditioner 59. Circuit 106 connects solenoid 2 to switch 54 where the power source is determined. B+ power is applied to solenoid 2 through circuit 72 by switch 54 until primary control arm 58 has returned to its at rest position at which time switch 54 disconnects B+ power from solenoid 2. Electric power originates at B+ at air conditioner 59 and is disconnected from solenoid 2 by switch 54 allowing solenoid 2 to go back to its at rest position and lock primary control arm 58 in place. B+ at air conditioner 59 travels throughout the control circuit 72 and returns to air conditioner 59 to direct F representing fan, C representing cool and H representing heat, as well as all electromagnets and time delay units being grounded to CO representing common or ground. Air conditioner 59 represents a heating, cooling and ventilating device. B+ at air conditioner 59 enters main switching relays 44 and 45 shown in their at rest position through circuit 72. Main switching relays 44 and 45 are controlled by electromagnets 46 and 47 respectively, which are grounded through circuits 53 and 69 respectively. When zone thermostat 32 calls for any function from air conditioner 59 before zone thermostat 35 calls for a function from air conditioner 59, then B+ power is applied through fan circuit 40 which applies B+ power to time delay 42 to electromagnet 46 for main switching relay 44. After time delay 42 has waited the predetermined period of time, then B+ power is applied to electromagnet 46 and through switch 50 to damper door control circuit 63 and 104. When B+ power is applied to electromagnet 46 then switching relay 44 is operated and; B+ power through circuit 34 to thermostat 35's B+ is disconnected, thermostat 32's heat circuit 36 is connected to the main switching relays' heat circuit 73 through an interrupter circuit's main relay switch 52 to air conditioner 59's heat circuit 76, thermostat 32's cool circuit 38 is connected to air conditioner 59's cool circuit 74 which passes through switch 50, and thermostat 32's fan circuit 40 is connected to air conditioner 59's fan circuit 75 which passes through switch 50. When thermostat 35 calls for any function from air conditioner 59 before thermostat 32 calls for a function from air conditioner 59 then B+ power is applied to fan circuit 41 which applies B+ power through time delay 43 to electromagnet 47 through circuit 89, system function switch 83 and circuit 62 for main switching relay 45. After time delay 43 has waited the predetermined period of time, then B+ power is applied to electromagnet 47 through switch 50 to and damper door control circuit 64. When B+ power is applied to electromagnet 47 then switching relay 45 is operated and; B+ power through circuit 33 to thermostat 32's B+ is disconnected, thermostat 35's heat circuit 37 is connected to air conditioner 59's heat circuit 76, thermostat 35's cool circuit 39 is connected to the main switching relays' heat circuit 73 through an interrupter circuit's main relay switch 52 to air conditioner 59's cool circuit 74 which passes through switch 50, and thermostat 35's fan circuit 41 is connected to air conditioner 59's fan circuit 75 which passes through switch 50. B+ Power circuit 72 may be disconnected from both thermostats by the B+ power interrupter circuit represented by components 10, 11, 12, 13 and 14. The main heat circuit 76 may be disconnected from both thermostats by the heat interrupter circuit represented by components 51, 52, 55, 91 and 92. When humidistat 56 senses a need for dehumidification and closes its normally open circuit, B+ power from circuit 72 is applied to the B+ power interrupter circuit from circuit 66 through circuit 97 and B+ power is applied to the heat interrupter circuit also through circuit 97 and B+ power is also applied to dime delay 57 through circuit 80. When humidistat 56 senses a need for dehumidification; B+ power to main switching relays 44 and 45, and to thermostats 32 and 35 is disconnected by the B+ power interrupter circuit and heat circuit 73 and 76 is disconnected by the heat interrupter circuit from air conditioner 59 immediately, positively shutting off the heat cycle from air conditioner 59 and disconnecting any thermostat's call for any function from air conditioner 59. The interrupter circuits as well as time delay 57 can also be energized by manual switch 48 through circuit 65 having the same results as when humidistat 56 calls for a function. When humidistat 56 or manual switch 48 applies B+ power to the B+ power interrupter circuit then B+ power is applied to electromagnet 13 through circuit 71 and 98 which passes through switching relay 12 which is shown in its at rest position. Electromagnet 13, which is grounded through circuit 82 then opens circuit 72 to main switching relays 44 and 45 by operating switching relay 14 which is shown in its at rest position. Also when B+ power is applied to circuit 97, time delay 10 is activated and after a predetermined period of time, B+ power is applied through circuit 81 to electromagnet 11, which is grounded through circuit 9, which operates switching relay 12 which disconnects B+ power from electromagnet 13 through circuit 98 which allows switching relay 14 to return to its at rest position as shown and restores circuit 72 to a closed circuit. When humidistat 56 or manual switch 48 applies B+ power to the heat interrupter circuit, then B+ power is applied to electromagnet 55 through circuits 93 and 95 which passes through switching relay 91 which is shown in its at rest position. Electromagnet 55, which is grounded through circuit 77 then disconnects circuit 73 and 76 by operating switching relay 52 which is shown in its at rest position. Also when B+ power is applied to circuit 97, time delay 51 is activated and after a predetermined period of time, B+ power is applied through circuit 96 to electromagnet 92, which is grounded through circuit 94, which operates switching relay 91 which disconnects B+ power from electromagnet 55 through circuit 95 which allows switching relay 52 to return to its at rest position as shown and restores circuits 73 and 76 to a closed circuit. Time delay 57 allows time for damper doors 5 and 16 to close before humidity control switching relay 50 is operated by electromagnet 49 through circuit 68 and grounded through circuit 70. When switching relay 50 is operated, then B+ power from circuit 72 is applied to solenoid through circuits 63 and 104 unlocking damper door 5 while circuits 63 and 104 are disconnected from thermostat control. When switching relay 50 is operated, then B+ power from circuit 72 is applied to solenoid 20 through circuit 64 unlocking damper door 16 while circuit 64 is disconnected from thermostat control. Also when switching relay 50 is operated, B+ power is applied to fan circuit 75 and cool circuit 74, and so air conditioner 59 has B+ power applied to its fan and cool connections. At this same time the fan circuit 75 and cool circuit 74 are disconnected from the main switching relays 44 and 45. System option rotary switch 83 chooses any of three choices for types of operation for the two zone system illustrated. With system option switch 83 in the position shown, the system works automatically as illustrated previously on a first come first serve basis for individual control of zones. When system option switch 83 is in the next position, damper door control solenoid circuits 104 and 64 are connected with circuit 84, 85 and 88 so that both solenoids 2 and 20 are energized if either is energized. Also circuit 62 connecting thermostat 35 to main switching relay 45's electromagnet 47 is disconnected while main switching relay 44's electromagnet 46's ground circuit 53 is completed with circuit 87 allowing thermostat 32 to operate air conditioner 59 while both damper doors 5 and 16 are allowed to open freely. When system option switch 83 is in the third position, both damper door control solenoid circuits 104 and 64 together are connected with circuits 84, 85 and 88 so that both solenoids 2 and 20 are energized if either is energized. Through circuit 62 and 86, thermostat 35 is connected to main switching relay 45's electromagnet 47 and main switching relay 44's electromagnet 46's ground circuit 53 is disconnected. This allows thermostat 35 to control air conditioner 59 while damper door 5 and 16 are both allowed to open freely.

I claim:

1. In an air conditioning system for a plurality of zones including a heating and cooling means and using a plurality of zone thermostats and damper means each associated with a particular zone which damper means both open freely, when unlocked, by air flow and pressure and close by gravity and are locked closed the improvement comprising:

means allowing said damper means to open an adjustable amount determined by spring tension when locked closed;

control means which allow individual zone thermostats to unlock each of said damper means individually while locking the remainder of the damper means closed thereby allowing an adjustable amount of air to pass to each zone as determined by spring tension;

said control means further having means allowing a plurality of said damper means to be unlocked simultaneously by at least one of a manual switch and humidity activated switch while one or more of said zone thermostats is connected to control said heating means and said at least one switch activates said cooling means to accomplish dehumidification, said heating means being controlled by one or more of said plurality of zone thermostats;

said control means having a plurality of interrupter circuit means to restore normal operation to the system after a predetermined period of time has elapsed after said at least one manual switch and humidity activated switch is activated by deactivating the heating and cooling means entirely for a predetermined time sufficient to allow all of the air flow to cease so that the dampers can return by gravity to their closed positions;

said control means further having a mode which allows a plurality of said damper means to be unlocked simultaneously by an individual of said plurality of thermostats.

* * * * *